United States Patent [19]

Baumann et al.

[11] Patent Number: 4,662,773

[45] Date of Patent: May 5, 1987

[54] SEGMENTAL TUNNEL LINING CONSISTING OF REINFORCED CONCRETE TUBBINGS

[75] Inventors: Theodor Baumann, Ismaning; Otmar Schreyegg, Geretsried, both of Fed. Rep. of Germany

[73] Assignee: Phillip Holzman Aktiengesellschaft, Fed. Rep. of Germany

[21] Appl. No.: 483,234

[22] Filed: Apr. 8, 1983

[30] Foreign Application Priority Data

May 17, 1982 [DE] Fed. Rep. of Germany ..... 3218517

[51] Int. Cl.[4] ..... E21D 11/08

[52] U.S. Cl. ..... 405/152; 405/153

[58] Field of Search ..... 405/150, 151, 152, 153; 33/168 R; 52/245, 584

[56] References Cited

U.S. PATENT DOCUMENTS

| | | | |
|---|---|---|---|
| 450,065 | 4/1891 | Fontaine | 33/168 R X |
| 2,716,884 | 9/1955 | Rosenberg | 33/168 R X |
| 3,695,044 | 10/1972 | Hoshino et al. | 405/153 X |
| 4,075,855 | 2/1978 | Meldner | 405/152 |
| 4,104,885 | 8/1978 | Thomas | 405/153 |
| 4,497,590 | 2/1985 | Chase | 405/152 |

FOREIGN PATENT DOCUMENTS

| | | | |
|---|---|---|---|
| 1187257 | 2/1965 | Fed. Rep. of Germany . | |
| 2527743 | 8/1978 | Fed. Rep. of Germany . | |
| 903845 | 8/1962 | United Kingdom . | |
| 1185061 | 3/1970 | United Kingdom | 405/153 |
| 1292638 | 10/1972 | United Kingdom | 405/153 |
| 1408642 | 10/1975 | United Kingdom . | |
| 2124682 | 2/1984 | United Kingdom . | |

OTHER PUBLICATIONS

Report No. ACI 504 1 R-82 in "Concrete International", Jun. 1982, Seite 17-29.

Chapter 106; Report on Application of a Large Excavator Shield for the Castiglioni Tunnel, Seiten 1613 Bis 1650, insbes.

Firmendruckschrift der Interessengemeinschaft "Schildtunnel", Essen 1960, p. 12.

Firmendruckschrigt "Diwidag-Berichte", 1975-2, pp. 9 to 13, pp. 11 and 12.

"Tunnels & Tunnelling", Jul./Aug. 1979, pp. 13-18.

Werbeprospekt der Firma Roland Murer, Tunnelbaumaschinen, Untertagbau-Beratungen, Industrievertretungen.

Auszug aus Harald Wagner: Beton-und Stahlbetontubbings im Tunnelbau, Beton-und Stahlbetonbau 2/1964, p. 38.

Publication "Beton-und Stahlbetonbau" 1964, vol. 2, pp. 35 and 42, vol. 3, pp. 56 to 60, pp. 36 and 37.

Auszug aus Hochtief-Nachrichten Jan. 1969, p. 31.

Technical Leaflet Wayss & Freytag AG, 1/1976 Sammler Wilhelmsburg in Hamburg.

Broschure Tunnel-und Stollenbauten, 1963, p. 5 Wayss & Freytag AG, Selbstverlag.

Prospectus: "U-Bahn Munchen", Baulos 8/1-7.1, Eingang beim DPA 6, Jun. 1975.

Hochtief-Nachrichten, Jan. 1969, pp. 26 to 33.

Stra-Ben-und Tiefbau 34 (1980), vol. 5, pp. 22 and 24.

*Primary Examiner*—David H. Corbin

*Attorney, Agent, or Firm*—Scully, Scott, Murphy & Presser

[57] ABSTRACT

Segmental tunnel lining for tunnels, galleries and similar underground works, in which individual tubbings, made of reinforced concrete, are braced, in use, with each other both in annular or peripheral direction and in longitudinal direction with the aid of tension rods (3, 4) and corresponding tensioning elements (5). The rods connect neighboring tubbings (1) and extend in channels (2) in the tubbing. To obtain closed joints as planned in a simple and safe way, each tubbing has no less than one anchor element (6), which is firmly connected with the tubbing at least in the built-in state, for the purpose of anchoring the tension rod which effects the connection with the neighboring tubbing; and the tensioning element, which is arranged on the end of the tension rod opposite the anchor element, is freely accessible for the application of a tensioning machine in the direction of the shaft of the tension rod.

23 Claims, 13 Drawing Figures

SEGMENTAL TUNNEL LINING CONSISTING OF REINFORCED CONCRETE TUBBINGS

TECHNICAL FIELD OF THE INVENTION

This invention relates to a tubular lining consisting of individual tubular tubbing for tunnels, galleries and similar underground works, in which individual tubbings made of reinforced concrete are braced with each other both in the annular or peripheral direction and in the longitudinal direction with the aid of tension rods, provided with tensioning elements, which connect neighbouring tubbings and extend in channels in the tubbings.

BRIEF DESCRIPTION OF THE PRIOR ART

Tubbing as just described is, for example, described in the publication "U-Bahn München Baulos 8/1-7.1". In this known tubbing the individual tubbings have on their inside cassette-like indentations having a comparatively large surface area and limited all around by side walls out of which there project the tension rods which are to be provided with the tensioning elements. On account of the narrow spatial conditions resulting from the cassette side walls, apart from smaller auxiliary implements, larger tensioning machines, such as impact screwing apparatus, for effecting mutual bracing of the individual tubbings can hardly be applied or cannot be applied at all on the tensioning elements so that only imperfectly closed joints can be made. Furthermore, on account of the weakening of the individual tubbings, which is caused by the indentations and gives rise to cracking, anchorage of the tension rods in the concrete of the tubbings, which copes with all stresses, is not possible. The consequences of imperfectly closed joints, or the unsatisfactory anchorage, are concrete chipping in the joint region, leakages and also unplanned deformations of, and stresses on, the finished tunnel tube, for reasons which will next be discussed.

In so far as sealing members are provided in the ring-type joints, these sealing profiles where tunnel construction is effected utilising shield advance are only compressed through the driving presses of the shield which exert longitudinally directed pressure forces onto the tunnel tube. In the course of the shield advance these pressure forces are removed in terms of time and area. As a result of this, the sealing members relax and the ring-type joints open again. The sealing members in the longitudinal joints are not compressed whilst tubbing assembly takes place in the protection of the shield tail. Only when the shield has driven up, the longitudinal joints are partially closed through the radial loads which then act on the tube as a result of annular gap grouting, water pressure and rock pressure.

As a result of the undefined gaps in ring-type and longitudinal joints, in turn resulting from methods of construction and load conditions, the finished tubbing tube varies from the planned form. These variations are intensified through stresses of the tunnel tube outside the shield tail, for example through an uneven pressure distribution along the periphery in the case of annular gap grouting and through the necessary longitudinal action of the tunnel tube in the region where the annular gap grouting has not yet hardened. The variations in form result in a situation where the practically rigid reinforced concrete tubbings no longer fit on each other exactly enough. At the joints, cracks or displacements can arise. The loads acting upon the tunnel cannot be taken up as planned by the joint surfaces which are provided therefor and concrete chipping results.

The deformations due to the unavoidable longitudinal action of the tunnel outside the shield tail can lead to a rupturing of the ring-type joints and therewith to leakages. The waterproofness of the longitudinal joints is only attained through the compression of sealing profiles in these joints through the radial load as a result of annular cap grouting, water and rock pressure. that is only possible if the joints lie outside the protection of the shield tail. In order to avoid penetration of fine particles of earth into the joints and between the sealing profiles which are not yet compressed, in the case of the joint constructions, which are known at present, a special strip of rubber is inserted into the joint split outside the actual sealing members. The sealing effect of such a strip of rubber in respect of earth and pressurized water is naturally uncertain. The risk that the actual sealing members will lose their operability before the compression of the longitudinal joints is thereby great.

OBJECT OF THE INVENTION

According to the present invention there is provided tubbing for tunnels, galleries and similar underground works, in which the individual tubbings, made of reinforced concrete, are braced, in use, with each other both in annular or peripheral direction and in longitudinal direction with the aid of tension rods and corresponding tensioning elements, the rods connecting neighbouring tubbings and extending in channels in the tubbing; wherein each tubbing has no less than one anchor element, which is firmly connected with it at least in the built-in state, and which serves for anchoring the tension rod which effects the connection with the neighbouring tubbing, and wherein the corresponding tensioning element is arranged on the end of the tension rod opposite the anchor element and is freely accessible for the application of a tensioning machine in the direction of the shaft of the tension rod. There is hereby created a linging in which closed joints can be attained as planned in a simple and safe way.

The advantages attained lie in the fact through the firm connection of the anchor element with the tubbing and the free accessibility of the tension rod end, which is opposite the anchor element, the application of an effective tensioning machine, for example of an impact screwing apparatus, on the tensioning element is possible whereby a bracing of the individual tubbings is attained in the case of joints which are closed as planned. In addition, the danger of a cracking is eliminated because weakenings of material, as are caused through cassette-like intendations having a comparatively large surface area, are not present.

There is also provided a measuring instrument for checking the joint width between the tubbings, as defined above, out from the inside of the construction, comprising a wedge which can be inserted into the joint and which according to possible depth of insertion has a stop or visible mark working together with the inside of the construction.

BRIEF DESCRIPTION OF THE DRAWINGS

For a better understanding of the invention and to show how the same may be carried into effect, reference will now be made by way of example, to the accompanying drawings, in which.

DETAILED DESCRIPTION OF THE PREFERRED EMBODIMENTS OF THE INVENTION

Figure 1:
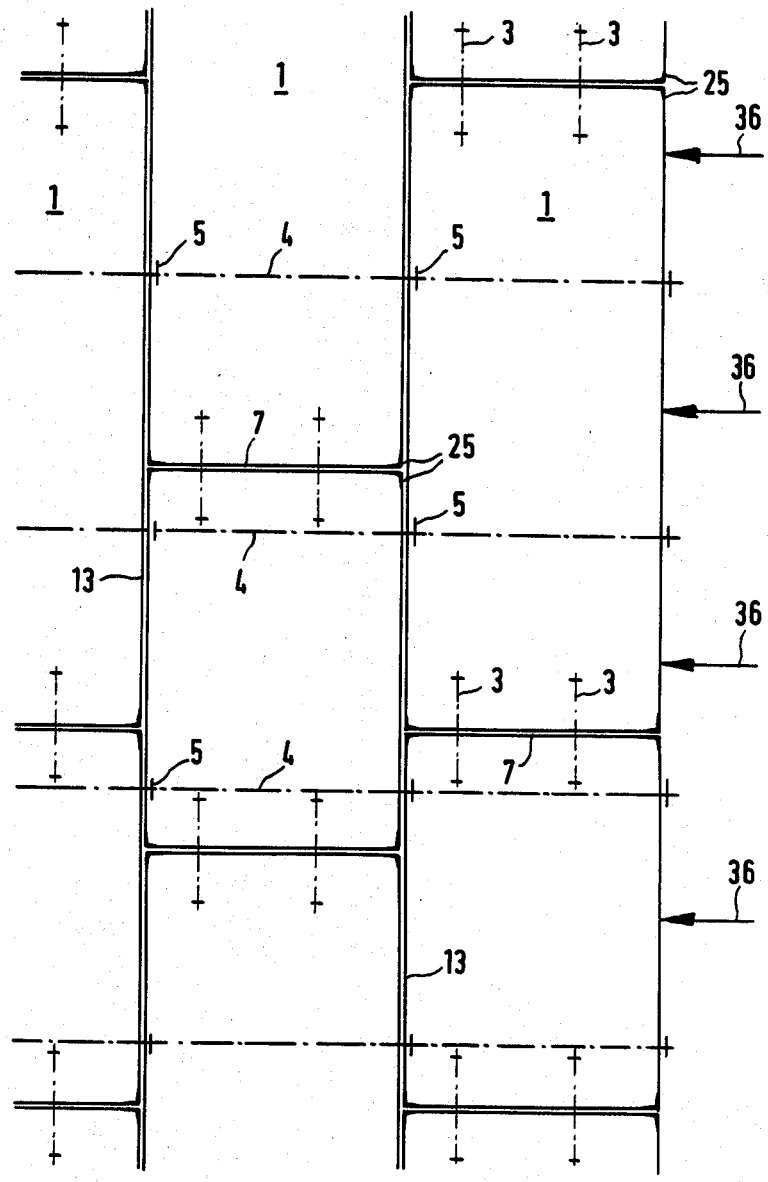
FIG. 1 is a developed view of lining as viewed from inside the tube.

As illustrated, a certain number of, for example eight, individual tubbings 1 and a keystone form a tubbing ring. Between the individual tubbing rings there are found, for example according to FIG. 1, ring-type joints 13 while longitudinal joints 7 are found between the individual tubbings. The longitudinal joints 7 of each tubbing ring are arranged displaced with respect to the longitudinal joints 7 of the neighbouring tubbing ring.

The tubbings 1, which are made of reinforced concrete, are braced one with another both in annular or peripheral direction and in longitudinal direction with the aid of tension rods 3, 4 which connect neighbouring tubbings and which extend in channels 2 (FIGS. 2 and 3) for which there is provision in each tubbing, and tensioning elements 5 corresponding to these.

Figure 2:
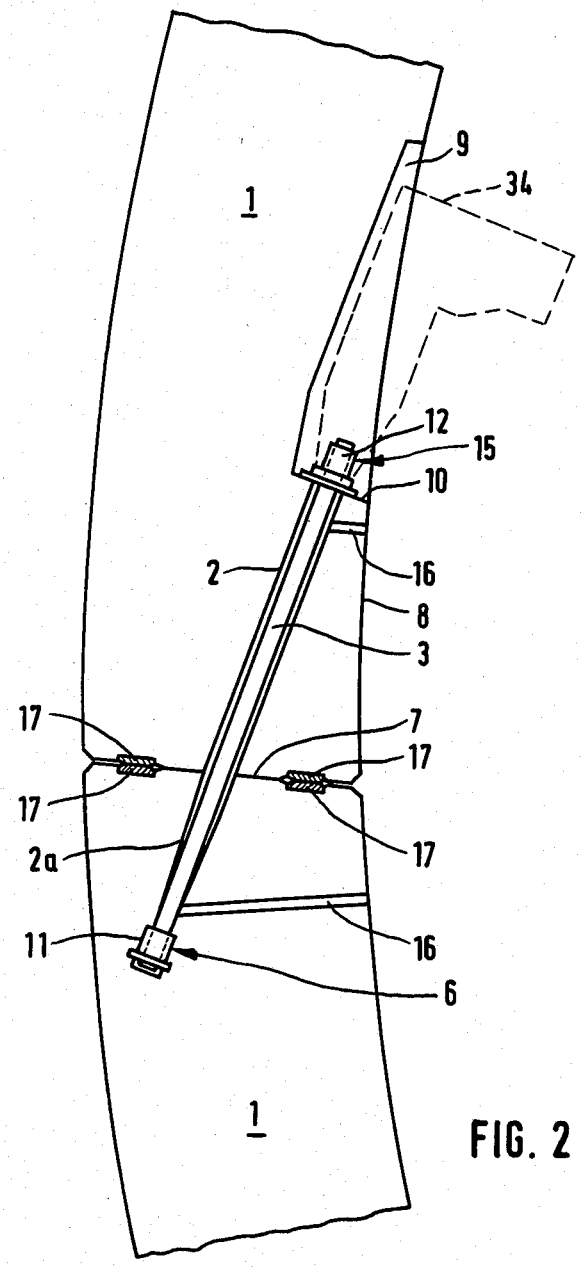
FIG. 2 is a radial section through a ring tension rod spanning two individual tubbings where they meet in a longitudinal joint.
Figure 3:
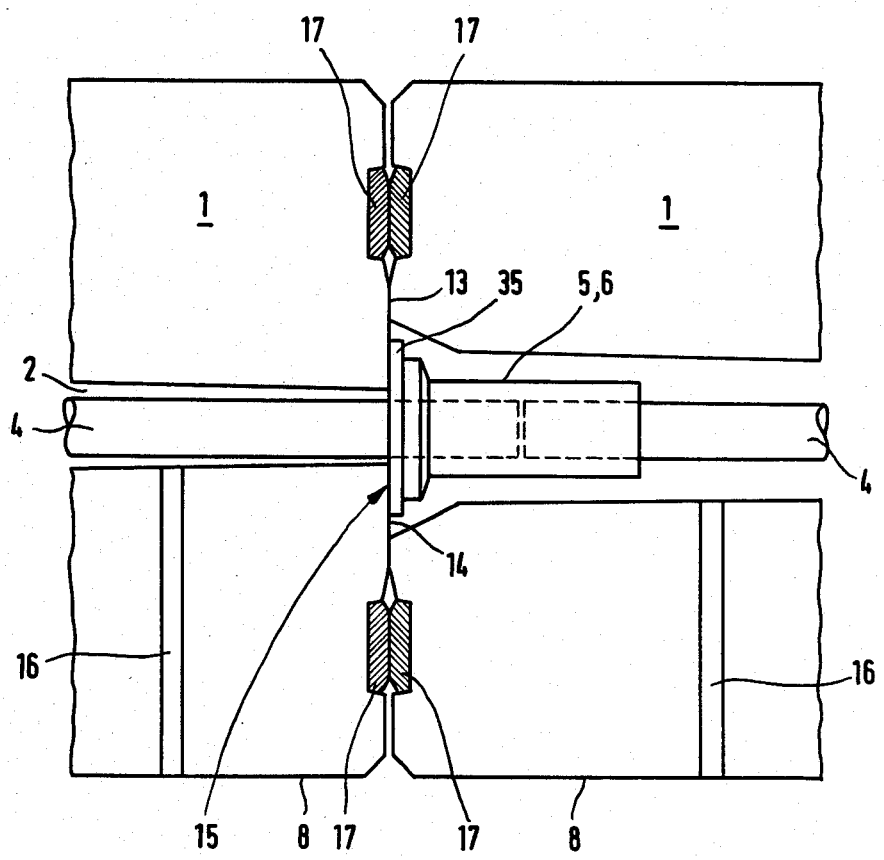
FIG. 3 is an axial section through a longitudinal tension rod spanning two individual tubbings where they meet in a ring-type joint.

As shown in FIGS. 2 and 3, each tubbing 1 has no less than one anchor element 6, which is firmly connected with it at least in the built-in state, for the purpose of anchoring the tension rod 3, 4 which effects the connection with the neighbouring tubbing 1. The tensioning element 5, which is arranged on the end of the tension rod 3, 4 opposite the anchor element 6, is, at least until the next tubbing 1 is built in, freely accessible for the application of a tensioning machine, for example, of an impact screwing apparatus 34, which is indicated in chain lines in FIG. 2, in the direction of the elongated shaft of the tension rod.

Referring to FIG. 2 the ring tension rods 3, which serve the purpose of bracing in annular or peripheral direction, extend in each case in such a manner that—in radial section (FIG. 2)—they cross at an oblique angle in each case the longitudinal joint 7 present between the two neighbouring tubbings 1. In detail, the construction is such that the end, which is opposite the anchor element 6, of each ring tension rod 3 opens out into a hollow 9 which is arranged on the tubbing interior surface 8 and which has a wall portion 10 which extends crosswise to the shaft of the ring tension rod and contributes to the installation of the tensioning element 5. Both ends of each ring tension rod 3 are provided with screw threading. The anchor element 6 includes a threaded sleeve 11 embedded in concrete. The tensioning element 5 includes a tensioning nut 12. The anchor element 6 including the threaded sleeve 11 receives the shaft of the ring tension rod 3 at a distance at least 15 cm from the longitudinal joint 7. By this means on the one hand a situation is reached where a perfect transfer of the prestressing forces from the screw anchorage to the ring reinforcement of the tubbing 1 is possible. On the other hand, the greater length of the ring tension rods 3 which is attained thereby is necessary in order to limit the bending stress of the tension rods 3. This stress then appears when the tubbing 1 is directed in tangential direction when prestressing. In the construction according to FIG. 2 the hollows 9 can in respect of breadth, width and depth be essentially smaller than in the case of the known cassette-like indentations. The danger of cracking of, and leakages in, the individual tubbings is considerably reduced still further thereby.

Referring to FIG. 3 the construction is such that the longitudinal tension rods 4, which serve the purpose of bracing in the longitudinal direction, in each case with formation of a continuous prestressing element, are connected with each other by means of connection elements. Both ends of each longitudinal tension rod 4 are provided with screw threading. One end projects out of the ring front surface 14 of the tubbing 1 which is facing the ring-type joint 13 present between two neighbouring tubbings. Onto this end there is screwed the connection element which simultaneously forms the tensioning element 5 for the one longitudinal tension rod 4 and the anchor element 6 for the next longitudinal tension rod 4. This connection includes a tensioning nut 15 open at both ends, which bears at one end by way of a ring flange 35 against the ring front surface 4 of the tubbing and into whose other end the end of the next longitudinal tension rod 4 is screwed. The individual longitudinal tension rods 4 can be simultaneously prestressed and coupled in a simple manner as the rods 3 in the ring-type joints 13. As a result, before the tubbing which is next in the longitudinal direction is built in, an impact screwing apparatus can be applied onto the tensioning element 5 without hindrance.

The channels 2, which are provided in the tubbings 1 and which receive the tension rods 3, 4 are at least partly conically formed. As shown in FIG. 2, of the channels 2 receiving the ring tension rods 3, only the channel portions **2*a* which lead to the anchor element are constructed conically, tapering out from the longitudinal joint 7. As shown in FIG. 3, the channels 2 receiving the longitudinal tension rods 4 are constructed conically enlarging out from the ring front surface 14 which forms an installation for the one end of the connection element. Such conical construction makes possible a subsequent insertion of the tension rods 3, 4** taking into account manufacturing and assembly tolerances.

Furthermore, from the channels 2 which receive the tension rods 3, 4,there extend injection channels 16 which open out at the tubbing interior surface 8 and which render possible the insertion of a suitable injection agent for the formation of protection against corrosion, or of an adhesive compound for the tension rods 3, 4.

In the ring-type joints 13 and in the longitudinal joints 7 in each case two sealing elements 17, which are provided at a radial distance from each other, corresponding to the tubbing, are arranged in a circular or continuous manner. The sealing elements 17 can be formed by profiled rubber strips or strips made of similar material. As a result, the construction is such that both sealing elements 17 are arranged in radial direction symmetrical to the central surface of the tunnel shell or to the tunnel shaft and to the centre of gravity of the joint contact surfaces which are statically effective. By this means, bending moments due to eccentrically operating restoring forces of the sealing elements 17, in the joint 7, 13 are avoided.

The prestressing of the ring and longitudinal screwing takes place when assembling the tubbing through impact screwing apparatus in such a way that the applied presstressing forces exert excess pressure on the restoring forces of the sealing elements 17 and the frictional forces in the joints 7, 13 with sufficient safety allowance and bring the concrete surfaces of the joints into pressure contact as planned. Both in the annular and in the longitudinal direction, special auxiliary presses are used which bring the tubbing 1 into the planned position. As a result, in the first instance excess pressure can be exerted on the sealing elements 17 in the longitudinal joints through the auxiliary presses and then the tensioning elements 5 can be tightened. The closing of the joints 7, 13 through prestressing the tension rods 3, 4, which is necessary for stability and waterproofness, takes place as planned in the protection of the shield tail (which is not represented) of a driving shield and is not subject to the respective pressing of the driving presses 36 (FIG. 1) or to the later radial tunnel load and the operatability of a rubber strip lying outside the actual sealing elements 17.

As the Figures show, the tension rods 3, 4 are arranged between both sealing elements 17.

Figure 4:
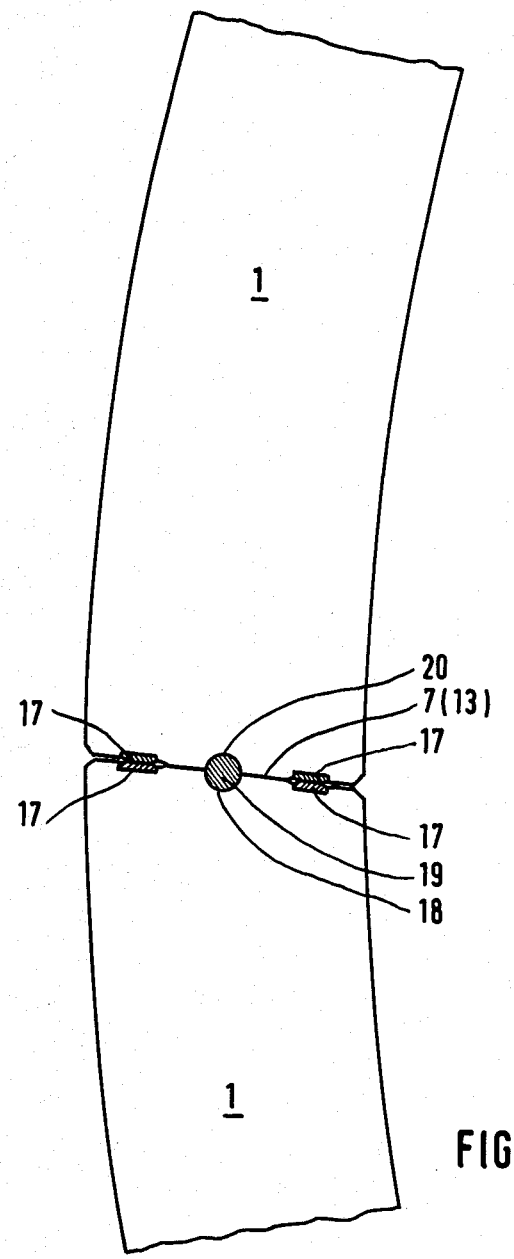
FIG. 4 is a sectional view of two individual tubbings where they meet.

In the embodiment according to FIG. 4 the construction is such that for the purpose of toothing neighbouring tubbings 1 in one of the tubbing sides facing the joints 7, 13, there is arranged a recess 18 and in the other of the named tubbing sides there is arranged a projection 19 corresponding to the recess. The projection 19, which is made of a smooth material, for example of synthetic material, is constituted by a round rod which projects by its semi-cross-section out of a groove 20 in which it is secured, for example in which it is cemented. Through this measure a mutual displacement of the tubbings 1 at the longitudinal joints 7 is avoided. Moreover, by this means, the off-drive forces are taken up as a result of the ring tension rods 3 which do not cross the longitudinal joint 7 at right angles.

Figure 7:
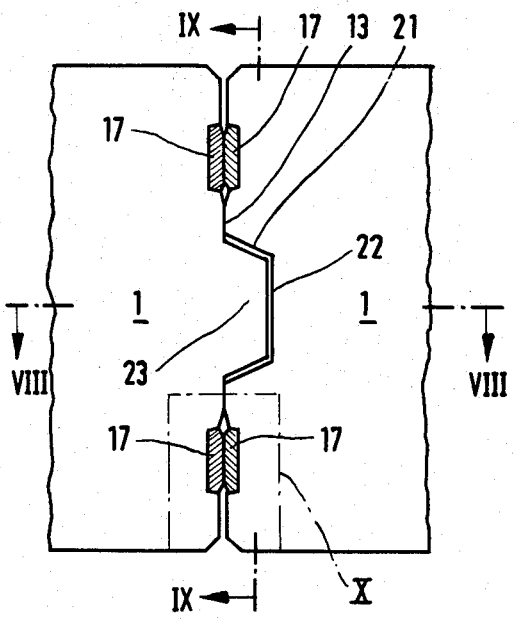
FIG. 7 is an axial section through a tooth construction of two individual tubbings meeting in a ring-type joint.
Figure 8:
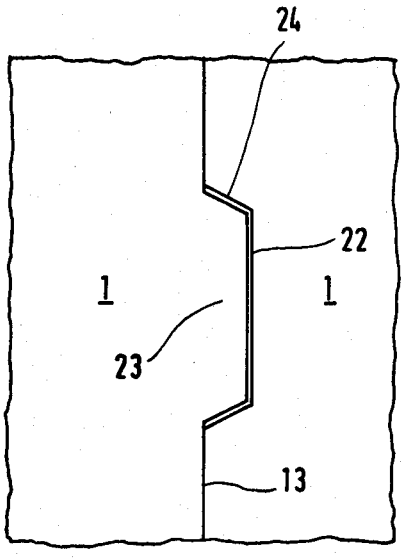
FIG. 8 is a section taken on line VIII—VIII in FIG. 7.
Figure 9:
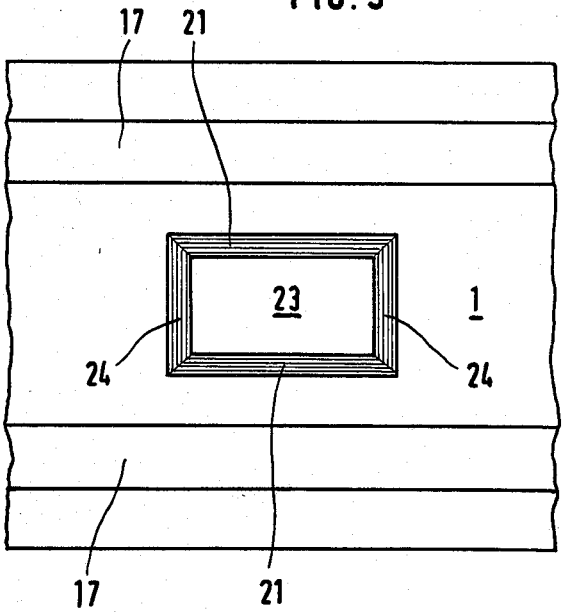
FIG. 9 is a section taken on line IX—IX in FIG. 7.

FIGS. 7 to 9 show a construction with a radial tooth construction 21 of neighbouring tubbings 1, which is arranged in the ring-type joints 13 and which is constituted by a groove 22 in one of the two tubbing sides facing the ring-type joint 13 and a tongue 23 made of the tubbing material on the other of the named tubbing sides. This tooth construction 21 is provided, with formation of naps having circular edges or slopes, spaced only at single points over the periphery of the ring-type joints 13, preferably at two points per tubbing. The groove 22 is, as a result, on account of its limited length in the face of chipping essentially less endangered than a continuous groove as provided in known constructions. The ends 24 of the tongues 23 pointing in the annular or peripheral direction form a tangential tooth construction with the grooves 22.

On account of the prestressing of the ring tension rods 3 and of the longitudinal tension rods 4 and on account of the tooth construction in radial and tangential directional longitudinal structural action of the tunnel tube are made possible. More particularly, in the region behind the shield tail, where before the annular gap grouting hardens the elastic bedding of the tunnel is not yet given through the surrounding rock, deformations of the tunnel tube and the disadvantages connected with this for stability and waterproofness are avoided through the named measures.

In certain cases the longitudinal structural conditions of the tunnel can be of interest not only during the state of assembly but in the long run, for example in the case of elevated tunnels in inner-city regions where later construction measures near the tunnel tube cannot be safely precluded. The protection against corrosion of the longitudinal and ring tension rods 4, 3, which is then necessary, can be attained through a subsequent injection which takes place by way of the mentioned injection channels 16.

Figure 6:
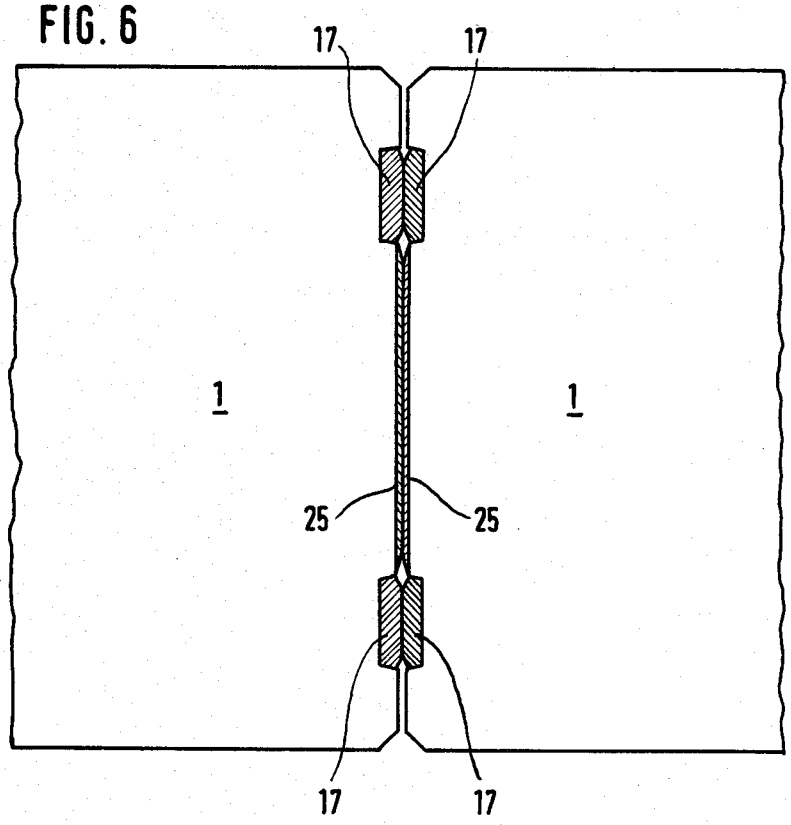
FIG. 6 is a section on line VI—VI in FIG. 5.
Figure 5:
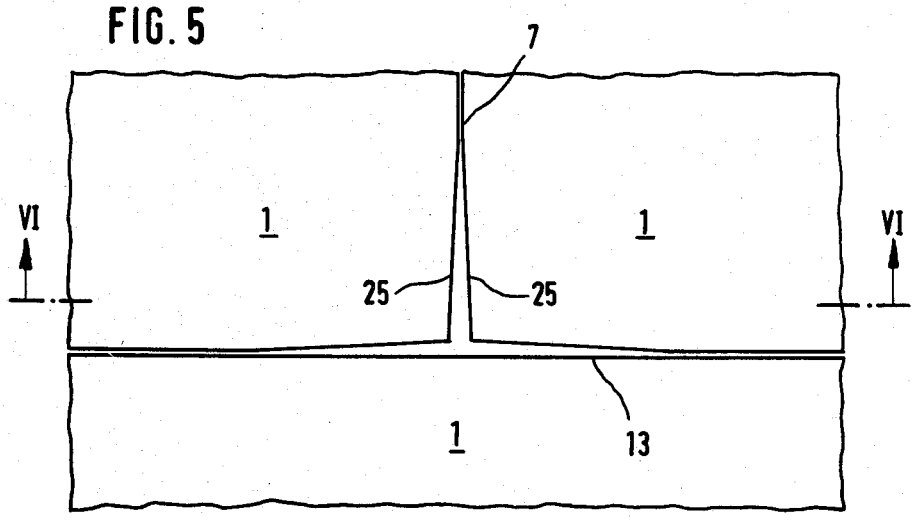
FIG. 5 is a cutaway portion, turned through about 45°, from FIG. 1 and on an enlarged scale.

According to FIGS. 5 and 6 the tubbing sides, which are provided for the pressure transfer and which are turned towards each other in the ring-type joints 13 or in the longitudinal joints 7, have chamfers 25 which taper off gradually to nil from a crest value at the tubbing corners. The depth of each chamfer 25 is at least as great as the possible projections of the ring-type joints 13 in the longitudinal direction of the tunnel as a result of manufacturing and assembly tolerances. By this means, a situation is reached where the longitudinal forces of pressure are not transferred at the corners of projecting tubbings 1, thereby avoiding chipping. Additional pads in the ring-type joints transferring pressure, as are used in hitherto known joint constructions, are thus not necessary.

Figure 13:
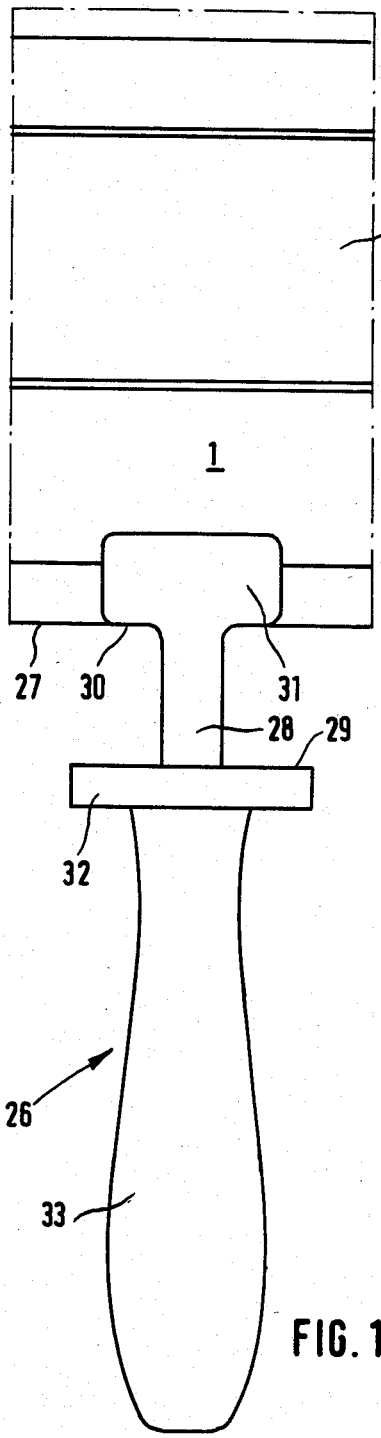
FIG. 13 is a section taken on line XIII—XIII in FIG. 10.
Figure 10:
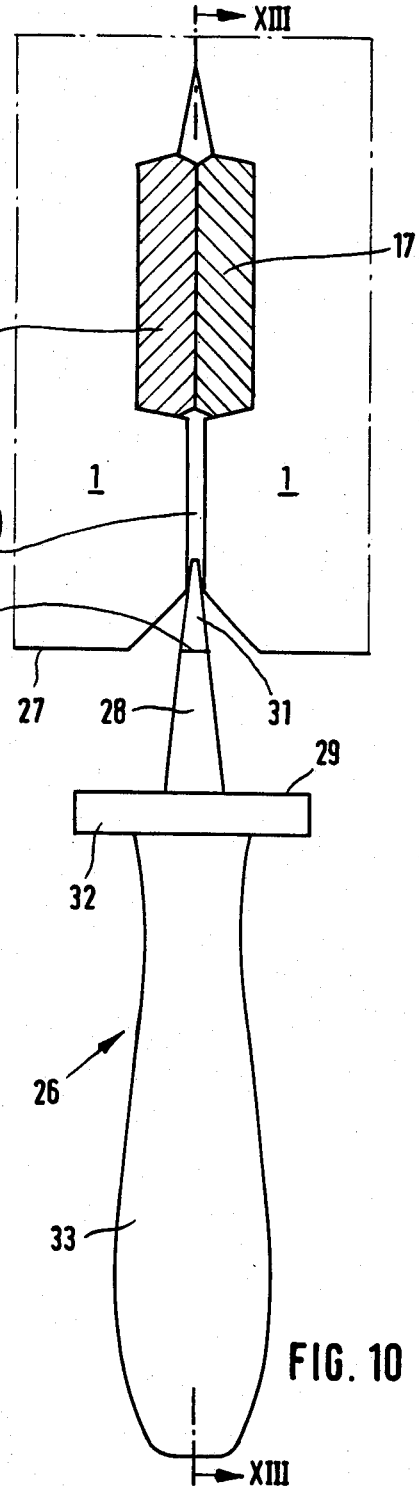
FIG. 10 is the cutaway portion designated at X in FIG. 7, drawn on an enlarged scale.
Figure 11:
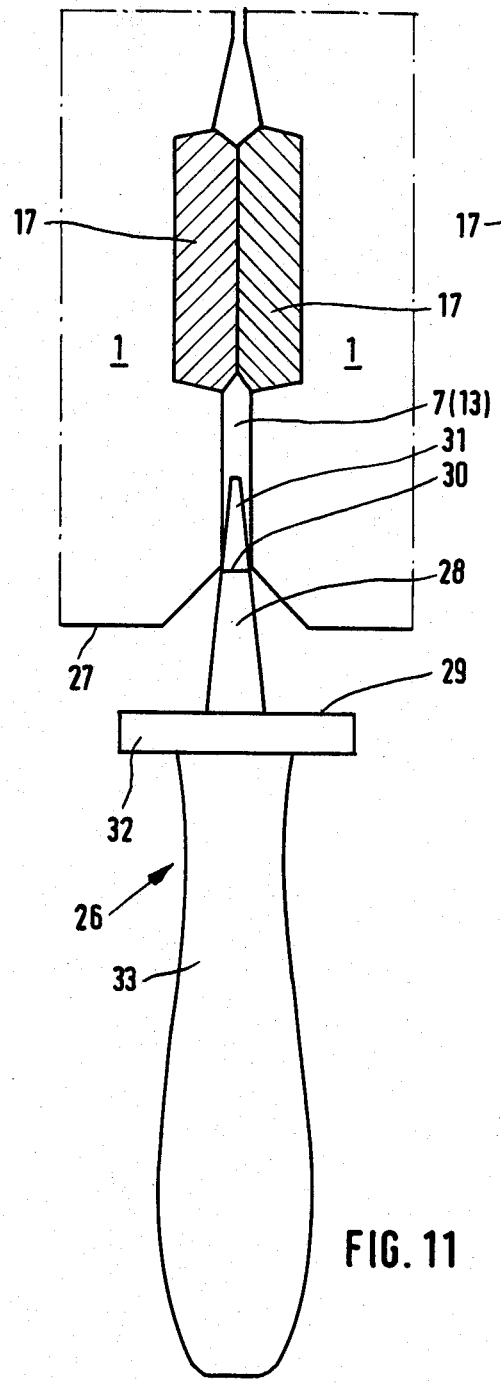
FIG. 11 shows a variation of what is shown in FIG. 10.
Figure 12:
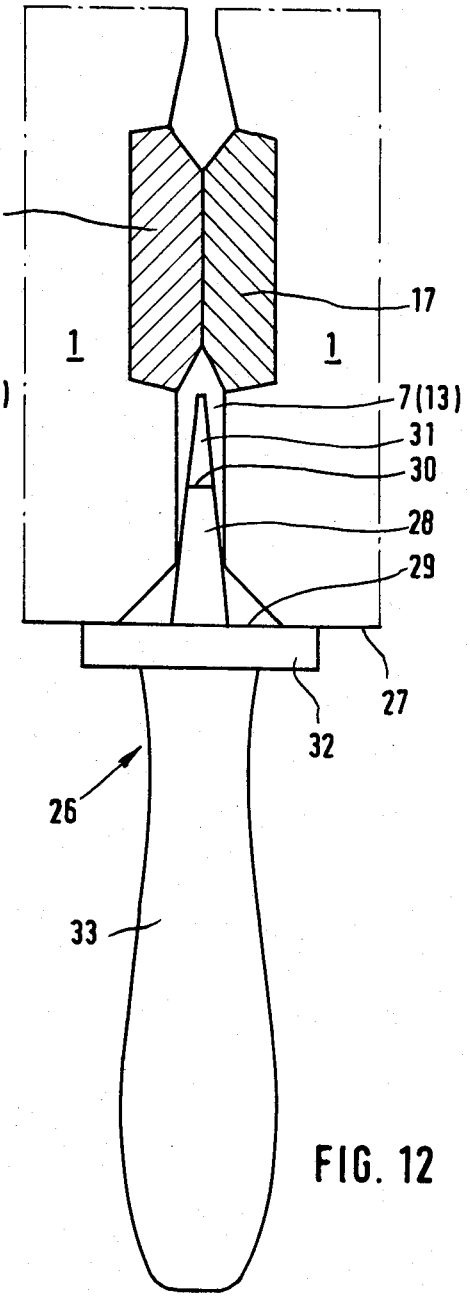
FIG. 12 shows a further variation of what is shown in FIG. 10.

In the practical construction work the planned compression of the sealing elements 17 through the prestressing can be checked in a simple manner with a measuring instrument 26, which is represented in FIGS. 10 to 13, for measuring the joint gap or joint width from the inside of the tubbing. The measuring instrument 26 has a wedge 28 which can be inserted into the joint 7, 13 and which according to possible depth of insertion has a stop 29 or visible marks 30 working together with the inside 27 of the construction. The wedge 28 is provided at its wide end with the stop 29 which when the joint width (FIG. 12) is inadmissibly great on both sides of the joint 7, 13 enters into the inside of the construction. Furthermore, the wedge 28 has at its narrow end along the lines of a T a crossbar 31, whose lower edge, that is the edge turned towards the stop 29, which forms a visible mark 30, is flush with the inside 27 of the tubbing when the joint width is as desired, that is, when the joint 7, 13 is closed as planned (FIGS. 10 and 13). The stop 29 is constituted at the side, which is facing the wedge 28, by a haft 32 onto which a handle 33 is joined on the side turned away from the wedge.

What is claimed is:

1. A tunnel segment defining an annular direction and a longitudinal axis, comprising:

a multitude of tubbings forming a number of annularly extending ring sections arranged side by side along the longitudinal axis;

each tubbing including (i) a longitudinally extending channel, (ii) first and second annular, linear channels, and (iii) at least one anchor element secured within the first annular channel;

the tubbings being positioned with the first annular channel of each tubbing aligned with the second annular channel of an annularly neighboring tubbing, and with said first and second annular channels extending substantially in the annular direction and also slightly radially inwardly, toward the longitudinal axis of the tunnel segment, from the anchor element secured within said first annular channel;

the tunnel segment further comprising:

longitudinal connecting rods extending through the longitudinally extending channels;

longitudinal tension means mounted on the longitudinal connecting rods to hold longitudinally neighboring tubbings together;

annular connecting rods extending within annularly neighboring tubbings, each annular connecting rod having (i) a first end connected to the anchor element of one tubbing, and extending from said anchor element and through the first annular channel of said one tubbing, and (ii) a second end extending through the second annular channel of a tubbing annularly adjacent said one tubbing;

annular tension means mounted on the second ends of the annular connecting rods to hold annularly neighboring tubbings together.

2. A tunnel segment according to claim 1 wherein:

each tubbing includes inside and outside circumferential surfaces respectively defining inside and outside planes;

each pair of annularly neighboring tubbings form a joint therebetween including a central, subsequently planar portion substantially perpendicular to the inside and outside planes defined by the neighboring tubbings; and the annular connecting rod extending within said pair of neighboring tubbings extends across the joint therebetween, through and substantially perpendicular to the central portion of the joint.

3. A tunnel segment according to claim 2 wherein:

the inside circumferential surface of each tubbing includes a recess;

the second ends of the annular connecting rods extend into the recesses;

each recess includes a surface portion extending perpindicularly to the annular connecting rod extending into the recess; and the annular tension means engages said surface portions of the recesses to hold the annular connecting rods tightly within the tubbings.

4. A tunnel segment according to claim 2 wherein:

the anchor elements include threaded sleeves;

the first ends of the annular connecting rods are threaded into the threaded sleeves; and the annular tension means includes threaded nuts threaded onto the second ends of the annular connecting rods.

5. A tunnel segment according to claim 2 wherein:

the longitudinal tension means connect together adjacent longitudinal connecting rods.

6. A tunnel segment according to claim 5 wherein:

each longitudinal connecting rod includes threaded first and second ends, and extends through one tubbing of one ring section and between neighboring tubbings of another ring section;

the longitudinal tension means includes threaded nuts;

each threaded nut is (i) threaded onto the second end of one longitudinal connecting rod and engages a front surface of the one tubbing through which said one longitudinal connecting rod extends to hold said one longitudinal connecting rod tightly within said one tubbing, and (ii) is threaded onto the first end of another longitudinal connecting rod to anchor said other longitudinal connecting rods in the tunnel segment.

7. A tunnel segment according to claim 1 wherein:

the first annular channels includes conical portions; and the longitudinally extending channels include conical portions.

8. A tunnel segment according to claim 7 wherein:

each tubbing includes a left face and a right face;

the first annular channels extends leftwardly from the right faces of the tubbings, and the second annular channels extend rightwardly from the left faces of the tubbings;

each first annular channel includes an axis, and the sides of each first annular channel taper leftwardly toward the axis thereof; and each second annular channel defines an axis and the sides of each second annular channel are parallel to the axis thereof.

9. A tunnel segment according to claim 7 wherein:

the longitudinal tension means engages front faces of the tubbings to hold the longitudinal connecting rods in tension in the tubbings; and the longitudinally extending channels taper rearwardly outwardly.

10. A tunnel segment according to claim 1 wherein each tubbing further includes:

first and second annular end faces;

a first injection channel spaced from said end faces and extending from an outside surface of the tubbing to the first annular channel;

a second injection channel spaced from said end faces and extending from an outside surface of the tubbing to the second annular channel; and a third injection channel spaced from said end faces and extending from to an outside surface of the tubbing to the longitudinally extending channel.

11. A tunnel segment according to claim 1 wherein:

annularly adjacent tubbings form longitudinal joints, and longitudinally adjacent tubbings form ring-type joints; and selected ones of the longitudinal and ring-type joints each include a pair of sealing elements, each of the sealing elements forming a closed loop.

12. A tunnel segment according to claim 11 wherein:

selected ones of the longitudinal and annular connecting rods extend through the closed loops formed by selected pairs of sealing elements.

13. A tunnel segment according to claim 11 wherein:

the sealing elements of each selected joint are symmetrically arranged about a center of gravity of the selected joint.

14. A tunnel segment according to claim 1 wherein:

each tubbing includes first and second, opposite annular faces;

the first face including an outwardly extending projection, and the second face including an inwardly extending recess; and the tubbings are positioned with the projection of each tubbing located in the recess of a neighboring tubbing.

15. The tunnel segment according to claim 14 wherein:

the first face of each tubbing includes a groove; and the projection of each tubbing comprises a round rod secured in the groove of the tubbing.

16. A tunnel segment according to claim 14 wherein:

the projections of the tubbings are made from a material having a smooth surface.

17. A tunnel segment according to claim 1 wherein longitudinally adjacent ring sections form ring-type joints, each ring-type joint including a plurality of spaced apart, groove-tooth connections, each groove-tooth connection comprising:

a recess formed in a face of one tubbing; and a tooth extending into the recess from a face of a tubbing longitudinally adjacent said one tubbing.

18. A tunnel segment according to claim 17 wherein two groove-tooth connections are located along each tubbing.

19. A tunnel segment according to claim 17 wherein sides of each tooth facing the annular direction form a tangential tooth construction.

20. A tunnel segment according to claim 1 wherein:

sides of tubbings facing sides of other tubbings have champfers.

21. A tunnel segment according to claim 20 wherein:

the champfers have maximum depths at corners of the tubbings and gradually decrease in depth therefrom.

22. A tunnel segment according to claim 1 wherein:

each tubbing includes an inside circumferential edge and an outside circumferential edge;

each pair of annularly neighboring tubbings form an interface therebetween extending substantially planar from the inside circumferential edges to the outside circumferential edges of said pair of neighboring tubbings; and the annular connecting rod extending within said pair of neighboring tubbings extends through a central area of the interface therebetween, substantially perpendicular to the interface.

23. A tunnel segment according to claim 1, wherein each tubbing comprises a body, and the anchor element of each tubbing comprises a threaded sleave, separate from the tubbing body, and embedded therein when the tubbing is formed.

* * * * *